US009304480B2

(12) United States Patent
Nishimura

(10) Patent No.: US 9,304,480 B2
(45) Date of Patent: Apr. 5, 2016

(54) IMAGE FORMING APPARATUS INCLUDING BOARD TO SUPPLY POWER TO IMAGE FORMING UNIT AND RESIN FRAME TO SUPPORT BOARD

(71) Applicant: Brother Kogyo Kabushiki Kaisha, Nagoya-shi, Aichi-ken (JP)

(72) Inventor: Yohei Nishimura, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/309,914

(22) Filed: Jun. 20, 2014

(65) Prior Publication Data

US 2014/0376947 A1 Dec. 25, 2014

(30) Foreign Application Priority Data

Jun. 20, 2013 (JP) ..... 2013-129930

(51) Int. Cl.

*G03G 21/00* (2006.01)
*G03G 21/16* (2006.01)
*G03G 21/18* (2006.01)

(52) U.S. Cl.

CPC ..... *G03G 21/1619* (2013.01); *G03G 21/1853* (2013.01); *G03G 21/1867* (2013.01); *G03G 21/1652* (2013.01); *G03G 21/1842* (2013.01); *G03G 2221/1684* (2013.01)

(58) Field of Classification Search

CPC ..... G03G 15/80; G03G 21/1652; G03G 21/1867; G03G 21/1619; G03G 2221/166; G03G 2221/1678; G03G 2221/1684

USPC ..... 399/90

See application file for complete search history.

(56) References Cited

U.S. PATENT DOCUMENTS

| | | | | |
|---|---|---|---|---|
| 8,532,524 | B2 | 9/2013 | Souda | |
| 2011/0065336 | A1* | 3/2011 | Souda | 439/824 |
| 2011/0262173 | A1 | 10/2011 | Souda | |

FOREIGN PATENT DOCUMENTS

| | | | |
|---|---|---|---|
| JP | 2004-240403 | A | 8/2004 |
| JP | 2006-039500 | A | 2/2006 |
| JP | 2008-149619 | A | 7/2008 |
| JP | 2008-152117 | A | 7/2008 |
| JP | 2010-251635 | A | 11/2010 |
| JP | 2011-232513 | A | 11/2011 |

* cited by examiner

*Primary Examiner* — Clayton E Laballe
*Assistant Examiner* — Trevor J Bervik
(74) *Attorney, Agent, or Firm* — Banner & Witcoff, Ltd.

(57) ABSTRACT

An image forming apparatus includes an image forming unit including a photosensitive drum configured to rotate about a rotation axis of the photosensitive drum, a resin frame configured to support a first end of the image forming unit in an axial direction of the photosensitive drum, a sub frame supported by the resin frame, a board supported by the sub frame and configured to supply a high voltage to the image forming unit, and a springy electrode disposed on the board and apart from edges of the board such that the springy electrode is compressed between the image forming unit and the board. The sub frame includes a plurality of first support portions disposed to support the board at at least three support points and a plurality of second support portions disposed to be supported by the frame at at least three support points.

11 Claims, 7 Drawing Sheets

IMAGE FORMING APPARATUS INCLUDING BOARD TO SUPPLY POWER TO IMAGE FORMING UNIT AND RESIN FRAME TO SUPPORT BOARD

CROSS REFERENCE TO RELATED APPLICATION

This application claims priority from Japanese Patent Application No. 2013-129930, filed on Jun. 20, 2013 which is incorporated herein by reference in its entirety.

TECHNICAL FIELD

Aspects of the disclosure relate to an image forming apparatus including a board configured to supply power to an image forming unit and a resin frame configured to support the board.

BACKGROUND

Generally, a known image forming apparatus includes an image forming unit, a side frame supporting the image forming unit, a board supported outside the side frame by support portions of the side frame, and a plurality of springy electrodes disposed to pass through holes in the side frame and compressed between the board and the image forming unit. Specifically, the side frame disposed on a side surface of the image forming unit is a metal frame, and coupled to a lower end of the metal frame is a resin frame. Most of the springy electrodes are disposed in a central portion of the board and the support portions are disposed to support the central portion of the board.

SUMMARY

To reduce the weight of the image forming apparatus, a side frame made of resin is needed. However, in a case where the side frame is made of resin, if springy electrodes and the support portions are disposed as described above, the urging forces of the springy electrodes may be applied to the central portion of the side frame via the board and the support portions disposed toward the central portion, and thus the side frame may become deformed.

Illustrative aspects of the disclosure provide an image forming apparatus configured to reduce deformation of a resin-made frame that supports a board.

According to an aspect of the disclosure, an image forming apparatus includes an image forming unit including a photosensitive drum configured to rotate about a rotation axis of the photosensitive drum and a developing device configured to supply developer to the photosensitive drum, a resin frame configured to support a first end of the image forming unit in an axial direction of the photosensitive drum, a sub frame supported by the resin frame, a board supported by the sub frame and configured to supply a high voltage to the image forming unit, and a springy electrode disposed on the board and apart from edges of the board such that the springy electrode is compressed between the image forming unit and the board. The sub frame includes a plurality of first support portions disposed to support the board at at least three support points and a plurality of second support portions disposed to be supported by the frame at at least three support points. The first support portions of the sub frame supporting the board are located apart from edges of the board. The second support portions of the sub frame are disposed outside an area enclosed by the at least three support points of the first support portions.

As the second support portions are disposed outside the area enclosed by the first support portions, force from the springy electrode can be transmitted via the board and the sub frame toward the edges of the resin frame. This structure can reduce the deformation of the resin frame.

BRIEF DESCRIPTION OF THE DRAWINGS

Illustrative aspects will be described in detail with reference to the following figures in which like elements are labeled with like numbers and in which.

DETAILED DESCRIPTION

An illustrative embodiment will be described in detail with reference to the accompanying drawings. In the following description, a general structure of a color printer 1, as an example of an image forming apparatus, will be described in detail.

In the following description, orientations or sides of the color printer 1 will be identified based on the color laser printer disposed in an orientation in which it is intended to be used. In other words, in FIG. 1, the left side is referred to as the front or front side, the right side is referred to as the rear or the rear side, the up side is referred to as the top or upper side, and the down side is referred to as the bottom or lower side. The top-bottom direction may be referred to as a vertical direction.

Figure 1:
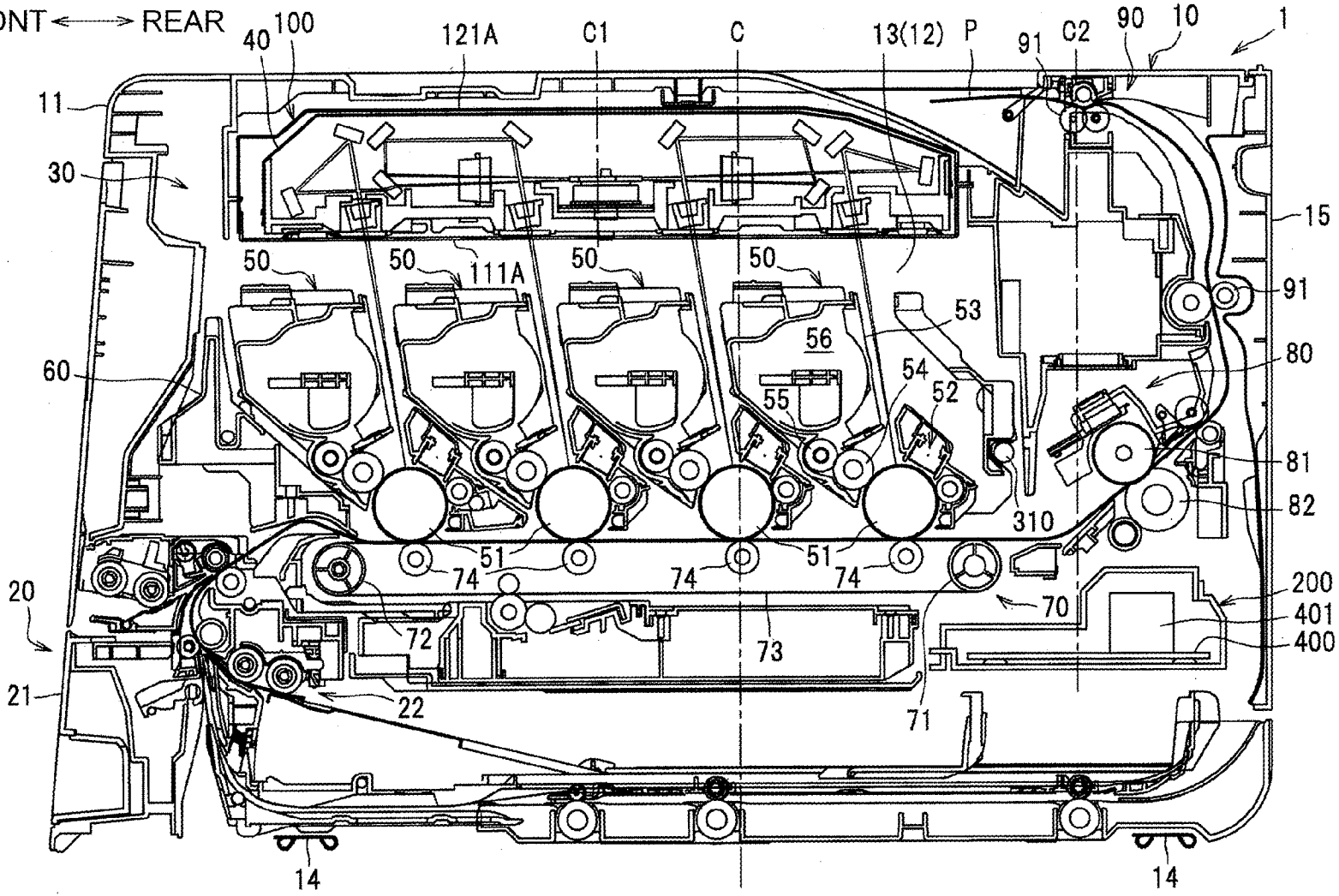
FIG. 1 is a sectional view of an illustrative image forming apparatus, e.g. a color printer, according to an embodiment of the disclosure.

As shown in FIG. 1, the color printer 1 includes a main body 10, a sheet feed unit 20 configured to feed a sheet P, an image forming portion 30 configured to form an image on the sheet P fed thereto, and a sheet ejection unit 90 configured to eject the sheet P having the image thereon.

The sheet feed unit 20 is disposed in a lower portion of the main body 10, and mainly includes a sheet tray 21 configured to accommodate sheets P therein, and a sheet feeding mechanism 22 configured to feed a sheet P from the sheet tray 21 to the image forming portion 30.

The image forming unit 30 is disposed above the sheet feed unit 20, and mainly includes an optical scanner 40, a plurality of, e.g. four, process units 50 as an example of a plurality of image forming units, a drawer 60, a transfer unit 70, and a fixing unit 80.

The optical scanner 40 is disposed above the process units 50, and includes a laser beam emitting unit (not shown), a polygon mirror, lenses and reflecting mirrors, which are shown without reference numbers. In the optical scanner 40, a laser beam emitted from the laser beam emitting unit based on image data is reflected at the polygon mirror and the reflecting mirrors, passes through the lenses, and irradiates a surface of each photosensitive drum 51 at high speed.

The process units 50 are arranged in an arrangement direction perpendicular to an axis of each of photosensitive drums 51, namely in the front-rear direction in this embodiment. Each of the process units 50 includes a photosensitive drum 51 configured to rotate about a rotation axis extending along the left-right direction, a charger 52 configured to charge the photosensitive drum 51, and a developing cartridge 53 as an example of a developing device. The developing cartridge 53 includes a developing roller 54 and a supply roller 55, which are configured to supply toner as an example of developer to the photosensitive drum 51, and a toner chamber 56 configured to store toner therein.

The charger 52 includes a charging wire and a grid electrode disposed between the charging wire and the photosensitive drum 51.

Figure 2:
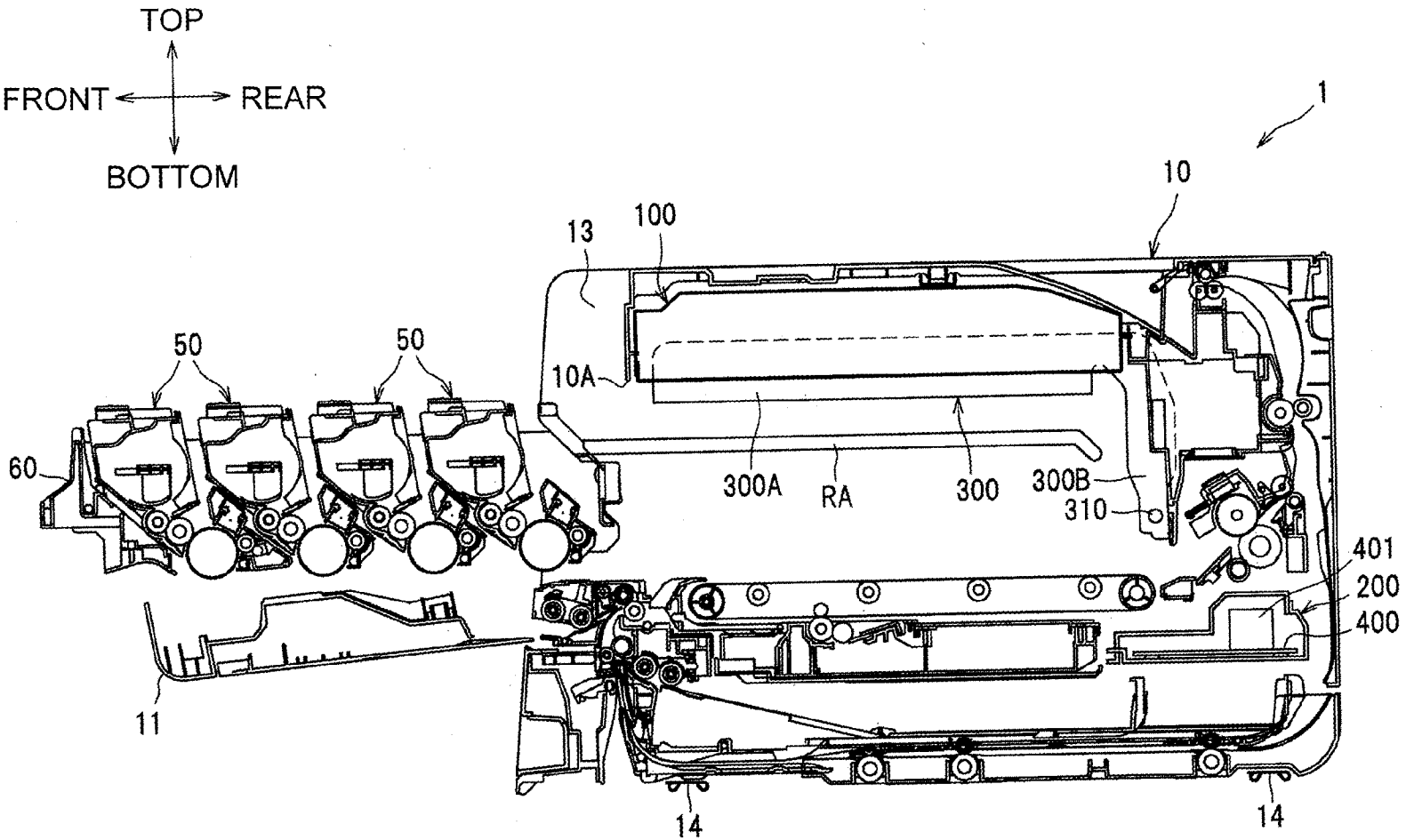
FIG. 2 is a sectional view illustrating that a drawer is pulled out from a main body of the color printer.

The drawer 60 is configured to support the process units 50 and to move in the front-rear direction relative to a pair of side frames 12, 13, which are left and right walls of the main body 10. Specifically, each of the side frames 12, 13 includes a rail RA (FIGS. 2 and 3) extending in the front-rear direction, and the drawer 60 is guided by the rails RA such that it is movable in the front-rear direction. As shown in FIG. 2, the drawer 60 is configured to be pulled outside the main body 10 through an opening 10A, which is open when a front cover 11 disposed on a front side of the main body 10 is open. Thus, the process units 50 can be exposed to outside.

Returning to FIG. 1, the transfer unit 70 is disposed between the sheet supply unit 20 and the drawer 60, and includes a drive roller 71, a driven roller 72, a conveyor belt 73, and a plurality of, e.g., four, transfer rollers 74.

The conveyor belt 73 is endless, and extends between the drive roller 71 and the driven roller 72, which are spaced apart in the front-rear direction and parallel to each other. The conveyor belt 73 contacts the photosensitive drums 51 at its outer surface. The transfer rollers 74 are disposed inside the conveyor belt 73 such that the conveyor belt 73 is sandwiched between the transfer rollers 74 and the photosensitive drums 51. The transfer rollers 74 are each configured to receive transfer bias by constant current control during image transfer.

The fixing unit 80 is disposed at the rear of the drawer 60 and the transfer unit 70, and mainly includes a pressure roller 81 and a pressure roller 82 disposed facing the heat roller 81 and configured to press the heat roller 81.

In the image forming unit 30, the surface of each photosensitive drum 51 is uniformly charged by a corresponding charger 52, and subsequently exposed to laser light from the optical scanner 40. Thus, the charges in an exposed area of each photosensitive drum 51 are removed, and an electrostatic latent image based on image data is formed on the surface of each photosensitive drum 51. Then, the developing roller 54 supplies toner stored in the developing cartridge 53 to the electrostatic latent image on the surface of each photosensitive drum 51 and a toner image is carried on the surface of each photosensitive drum 51.

Then, when a sheet P is fed in between each of the photosensitive drums 51 and the conveyor belt 73, the toner images carried on the surfaces of the photosensitive drums 51 are sequentially transferred onto the sheet P. The sheet P having the toner images transferred thereto passes between the heat roller 81 and the pressure roller 82 and the toner images transferred onto the sheet P are thermally fixed.

The ejection unit 90 mainly includes a plurality of feed rollers 91 configured to feed sheets P. The sheet P having the toner images thermally fixed is fed by the feed rollers 91 and ejected outside from the main body 10.

The structure of the main body 10 will be described in detail.

Figure 3:
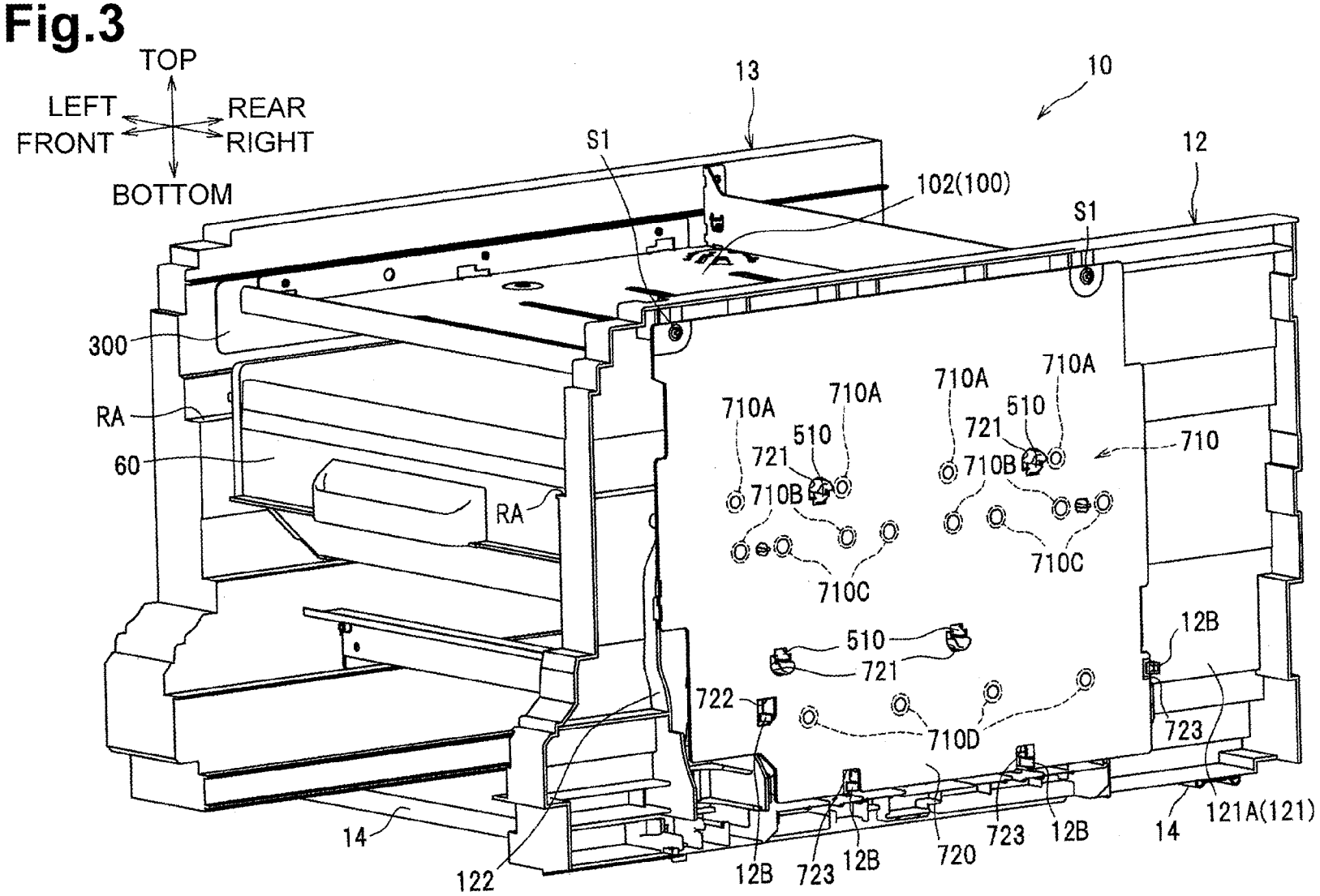
FIG. 3 is a perspective view of the main body.

As shown in FIGS. 1 and 3, the main body 10 includes a right side frame 12 and a left side frame 13, which are paired, a first connecting frame 100 connecting upper portions of the side frames 12, 13, a second connecting frame 200 connecting lower rear portions of the side frames 12, 13, and lower beams 14 each connecting lower ends of the side frames 12, 13. The lower beams 14 are metal plates elongated in the left-right direction, and disposed on the front side and the rear side of the side frames 12, 13, respectively.

The side frames 12, 13 are substantially rectangularly shaped and made of resin. The side frames 12, 13 are disposed facing each other with the process units 50 interposed therebetween, and configured to support the process units 50 via the drawer 60. In the following description, the side frame 12 disposed on the right side of the main body 10 is referred to as the right side frame 12, and the side frame 13 disposed on the left side of the main body 10 is referred to as the left side frame 13.

The right side frame 12 is an example of a frame, and configured to support the right ends of the process units 50 via the drawer 60. The right side frame 12 mainly includes a plate-like portion 121 having a flat surface 121A perpendicular to the left-right direction, and a reinforcing rib portion 122 protruding outward from the plate-like portion 121 in the left-right direction. The reinforcing rib portion 122 may protrude inward from the plate-like portion 121 in the left-right direction.

The left side frame 13 is an example of a second frame, disposed facing the right side frame 12 such that the process units 50 are interposed therebetween, and configured to support left ends of the process units 50 via the drawer 60. The left side frame 13 also includes a plate-like portion and a reinforcing rib portion (of which reference numbers are omitted) in like manner with the right side frame 12. The left side frame 13 is provided with a drive mechanism (not shown), which is disposed outside the left side frame 13 in the left-right direction and comprised of a plurality of gears for driving the photosensitive drums 51. The left side frame 13 is reinforced by the driving mechanism.

The first connecting frame 100 is a metal frame and is shaped like an enclosure having a closed cross section perpendicular to the left-right direction. Both end portions of the first connecting frame 100 in the left-right direction are connected to the side frames 12, 13. The first connecting frame 100 is disposed above the process units 50 and accommodates the optical scanner 40 inside.

Both ends of the first connecting frame 100 in the left-right direction are connected to the side frames 12, 13, which improves rigidity of the side frames 12, 13. The first connecting frame 100 accommodates the optical scanner 40 inside. Thus, the first connecting frame 100 has both the ability to improve the rigidity of the side frames 12, 13 and the ability to protect the optical scanner 40.

The first connecting frame 100 has substantially the same dimension in the front-rear direction as the drawer 60. When projected vertically, the first connecting frame 100 overlaps the process units 50. The first connecting frame 100 is sized over an entirety of the process units 50, which provides greater rigidity in the side frames 12, 13.

A center C1 of the first connecting frame 100 in the front-rear direction is spaced to the front side from a center C of the side frames 12, 13 in the front-rear direction. In other words, the first connecting frame 100 is disposed toward the front end of the side frames 12, 13 (rather than the rear end of the side frames 12, 13).

Figure 4:
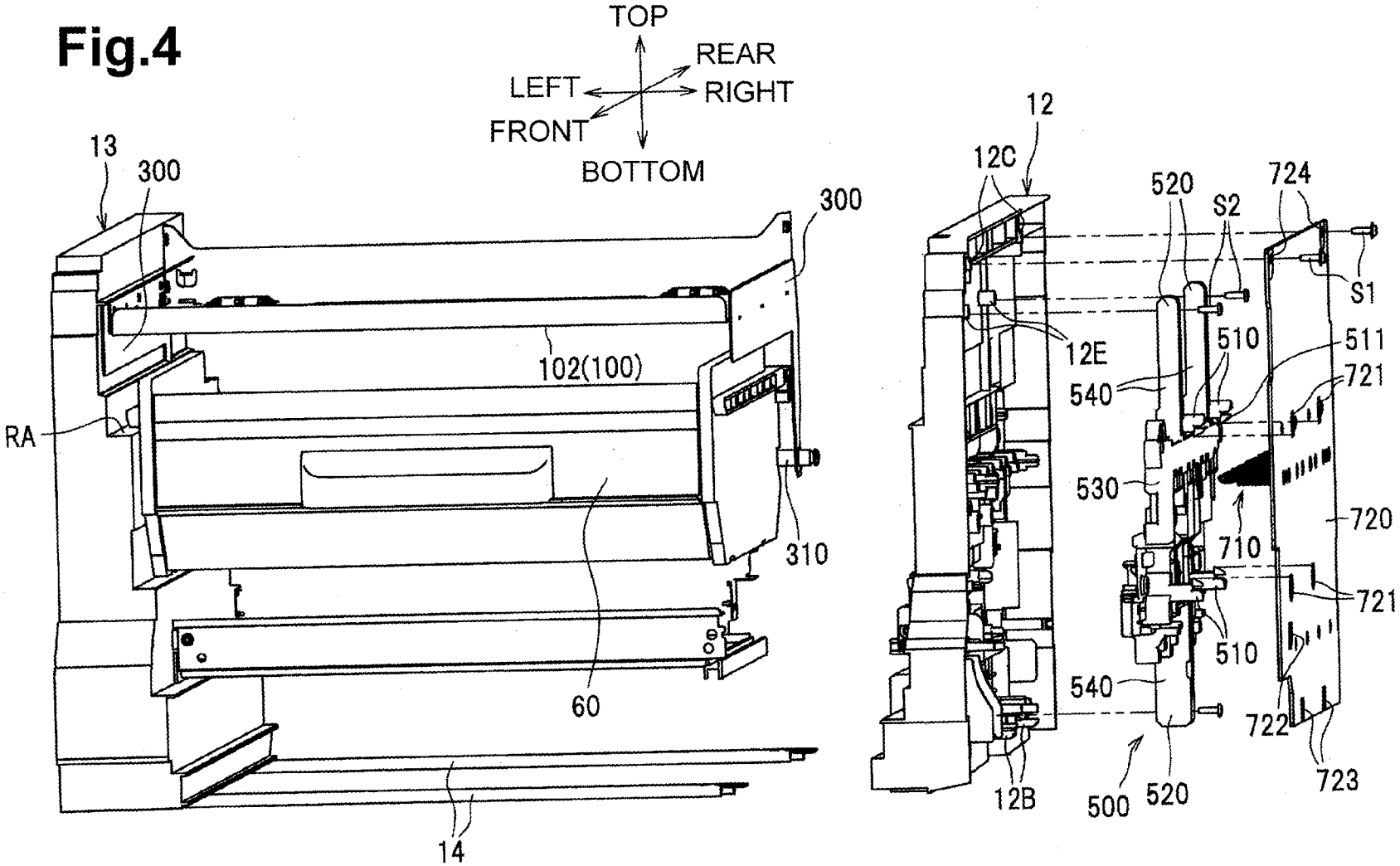
FIG. 4 is an exploded perspective view illustrating a right side frame, a sub frame, a board, and a first connection frame, which are disassembled from a first connecting frame.

More specifically, as shown in FIGS. 3 and 4, left and right ends of a lower wall portion 102 of the first connecting frame 100 are fixed to L-shaped metal plates 300, which are fixed to the side frames 12, 13. As shown in FIG. 2, the L-shaped metal plate 300 is made up of a main body portion 300A elongated in the front-rear direction and an extension portion 300 extending downward or toward the photosensitive drums 51 from the main body portion 300A. The main body portion 300A is disposed such that, when projected in the left-right direction (or in an axial direction of the photosensitive drum 51), the main body portion 300A overlaps the first connecting frame 100. The extension portion 300B supports a positioning shaft 310 (FIG. 1) to be engaged with a rear portion of the drawer 60 for positioning the drawer 60 in the main body 10. The L-shaped metal plates 300 are firmly fixed to the inside of the side frames 12, 13 in the left-right direction.

As shown in FIG. 1, the second connecting frame 200 is a metal frame, and is shaped like an enclosure having a closed cross section perpendicular to the left-right direction. Both end portions of the second connecting frame 200 in the left-right direction are connected to the side frames 12, 13. The second connecting frame 200 is disposed below the process units 50.

Thus, the first connecting frame 100 and the second connecting frame 200 are disposed such that the process units 50 are interposed between the first connecting frame 100 and the second connecting frame 200 vertically, and thus efficiently reinforce central portions of the side frames 12, 13 (which overlap the process units 50 in the axial direction of the photosensitive drum 51).

A center C2 of the second connecting frame 200 in the front-rear direction is spaced toward the rear end of the side frames 12, 13 from the center C of the side frames 12, 13 in the front-rear direction. In other words, the second connecting frame 200 is disposed toward the rear end of the side frames 12, 13 (rather than the front end of the side frames 12, 13).

Namely, the first connecting frame 100 is disposed toward the front end of the side frames 12, 13 and the second connecting frame 200 is disposed toward the rear end of the side frames 12, 13. Thus, the first connecting frame 100 and the second connecting frame 200 are disposed substantially diagonally with respect to the side frames 12, 13 and thus provide greater rigidity in the side frames 12, 13.

The second connecting frame 200 is of such size as to extend from the rear end portion of the first connecting frame 100 to near the rear end of the side frames 12, 13. Furthermore, the second connecting frame 200 is disposed to overlap the first connecting frame 100 when projected vertically.

The first connecting frame 100 and the second connecting frame 200 reinforce the side frames 12, 13, which provide greater rigidity in the side frames 12, 13.

The second connecting frame 200 accommodates inside a power supply board 400 configured to supply power to the process units 50. A transformer 401 (FIGS. 1 and 2) as an example of an element of a power supply circuit is mounted on the power supply board 400. As the power supply board 400 is accommodated in the second connecting frame 200 made of metal, the spreading of electromagnetic waves by the power supply board 400 can be reduced.

As shown in FIGS. 3 and 4, a plurality of coil spring electrodes 710, a high voltage supply board 720, and a sub frame 500 are disposed outside the right side frame 12 in the left-right direction (or on an opposite side from the process units 50). In FIG. 4, some of the coil spring electrodes 710 are omitted for convenience in illustration.

The high voltage supply board 720 is a board configured to transform electric power supplied from the power supply board 400 (FIG. 1) to an appropriate high voltage to supply the high voltage to the process unis 50 and the transfer rollers 74. The high voltage supply board 720 is greater in size than the sub frame 500 and disposed to cover the sub frame 500 from outside in the left-right direction. A central portion of the high voltage supply board 720 is supported by the sub frame 500 and upper and lower end portions of the high voltage supply board 720 is supported by the right side frame 12.

The central portion of the high voltage supply board 720 has four holes 721 in which four first support portions 510 of the sub frame 500 are to be engaged. A lower portion of the high voltage supply board 720 has a hole 722 and three cut portions 723 in which four engaging portions 12B of the right side frame 12 protruding outward in the left-right direction at a lower portion of the right side frame 12 are to be engaged. An upper portion of the high voltage supply board 720 has two through holes 724 in which two screws S1 for securing the high voltage supply board 720 to the right side frame 12 are to be inserted. An upper portion of the right side frame 12 has two cylindrical-shaped bosses 12C to which the two screws S1 are to be screwed.

The coil spring electrodes 710 each include a corresponding compressed coil spring and are configured to electrically connect the high voltage supply board 720 and each of the process units 50. Specifically, the coil spring electrodes 710 includes four wire-use electrodes 710A, four developing-use electrodes 710B, four gird-use electrodes 710C and four transferring-use electrodes 710D (see also FIG. 6). The wire-use electrodes 710A are provided in correspondence with charging wires 52A and equally spaced apart from each other in the front-rear direction. The wire-use electrodes 710A are configured to supply electric power to the respective charging wires 52A.

The developing-use electrodes 710B are provided in correspondence with the developing cartridges 53 and equally spaced apart from each other in the front-rear direction. The developing-use electrodes 710B are configured to supply electric power (developing bias) to the respective developing cartridges 53. More specifically, each of the developing-use electrodes 710B is configured to supply electric power to the developing roller 54 and the supply roller 55 in a corresponding one of the developing cartridge 53. The grid-use electrodes 710C are provided in correspondence with the grid electrodes 52B and are equally spaced apart from each other in the front-rear direction. The grid-use electrodes 710C are configured to supply electric power to respective grid electrodes 52B. The transferring-use electrodes 710D are provided in correspondence with the transfer rollers 74 and equally spaced apart from each other in the front-rear direction. The transferring-use electrodes 710D are configured to supply electric power (transferring bias) to the respective transfer rollers 74.

Figure 7:
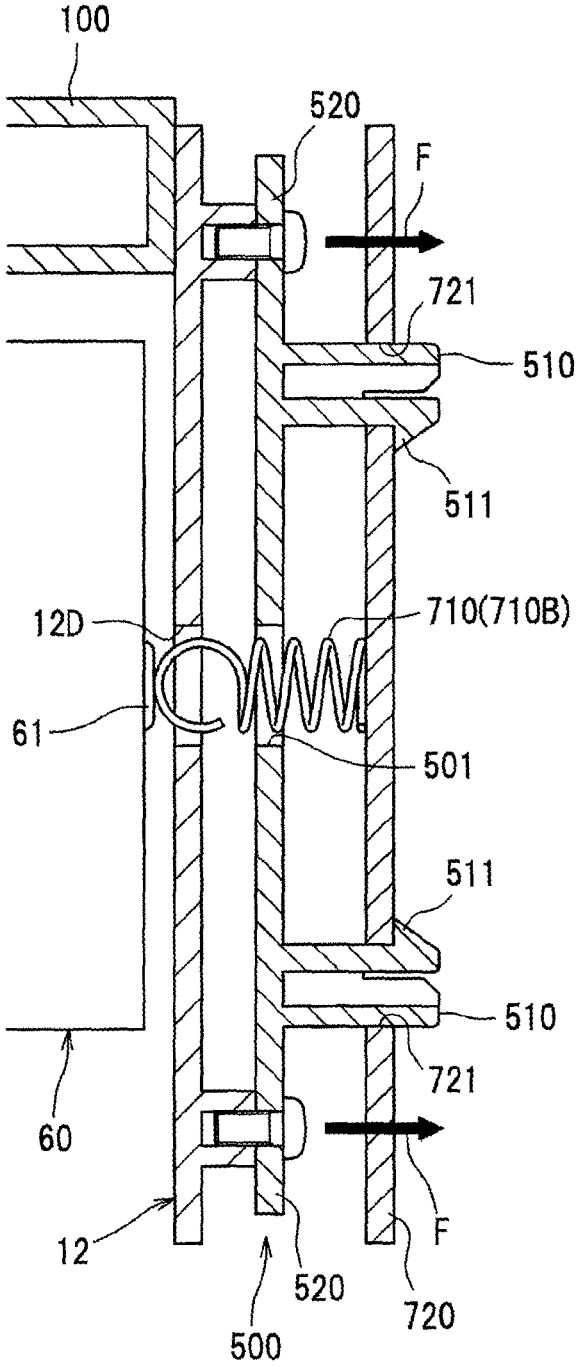
FIG. 7 is a sectional view of a coil spring electrode and its surrounding components.

Of the coil spring electrodes 710, the wire-use electrodes 710A, the developing-use electrodes 710B and the grid-use electrodes 710C are disposed in compressed state between the corresponding process units 50 and the high voltage supply board 720 and located apart from the edges of the high voltage supply board 720. Specifically, as shown in FIG. 7, each of the wire-use electrodes 710A, the developing-use electrodes 710B and the grid-use electrodes 710C is disposed such that its end protrudes from the right side frame 12 inward or toward the drawer 60 in the left-right direction through a corresponding through hole 12D in the right side frame 12 and a corresponding through hole 501 in the sub frame 500. The end of each electrode 710A, 710B, 710C is connected to an electrode of a corresponding one of the process units 50 via a relay conductor 61 disposed at the drawer 60. Each of the transferring-use electrodes 710D passes through the corresponding through holes 12D, 501, its end protrudes from the right side frame 12 inward or toward the drawer 60 in the left-right direction, and is connected to an electrode of a corresponding one of the transfer rollers 74.

Figure 5:
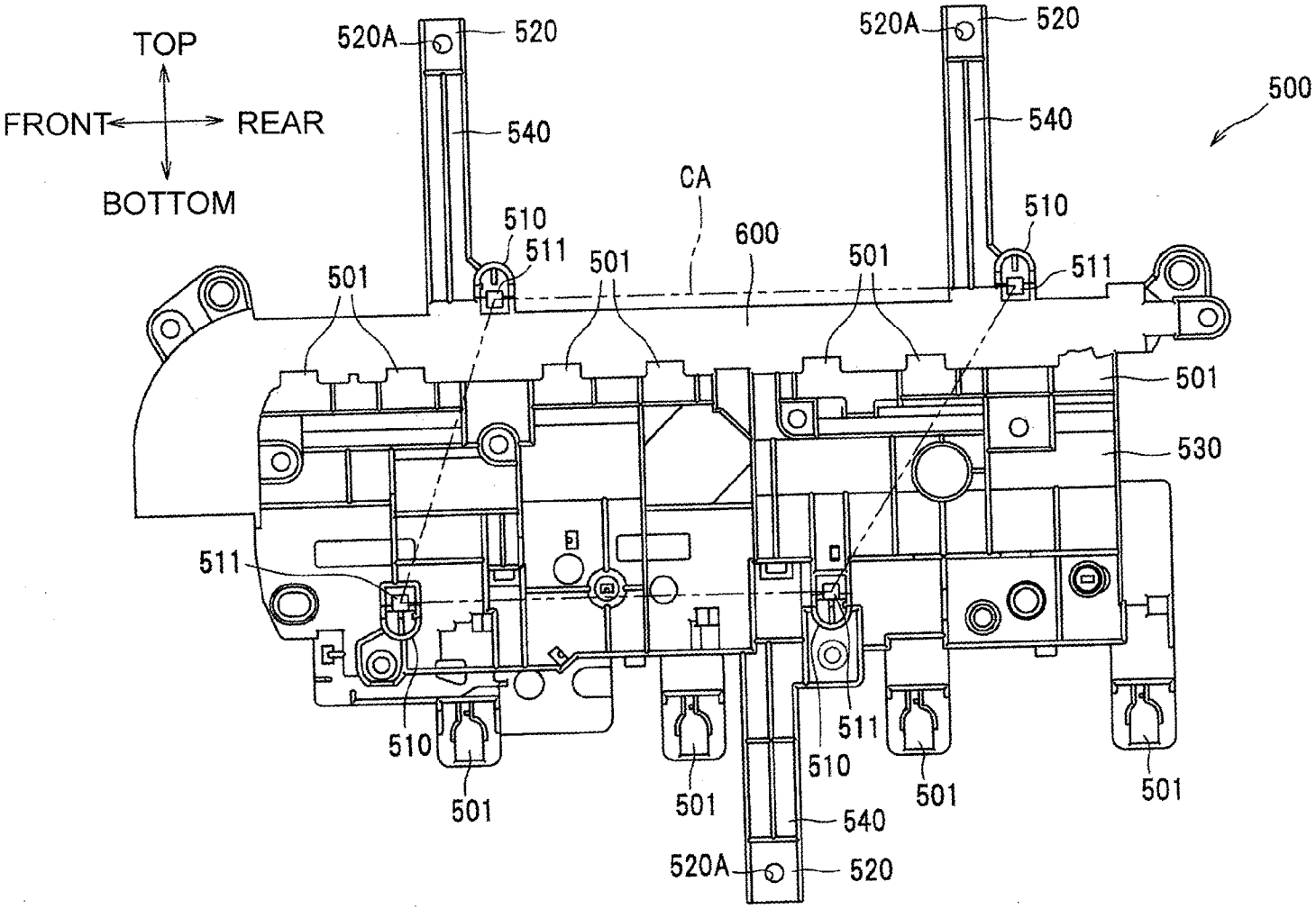
FIG. 5 is a side view of the sub frame.

The sub frame 500 is made of a material with a higher Young's modulus than that of the right side frame 12. As shown in FIGS. 4 and 5, the sub frame 500 mainly includes four first support portions 510 to support the high voltage supply board 720 at four points, three second support portions 520 to be supported to the right side frame 12 at three points, and a main body portion 530. The main body portion 530 is shaped like a rectangle elongated in the front-rear direction. A duct 600 for guiding air from a fan 601 (FIG. 6) to each process unit 50 is disposed in an upper portion of the main body portion 530. The main body portion 530 has a plurality of through holes 501 in correspondence with the developing-use electrodes 710B, the grid-use electrodes 710C, and the transferring-use electrodes 710D. The electrodes 710B, 710C, and 710C are to be inserted into the respective through holes 501.

Each first support portion 510 is disposed to protrude from the main body portion 530 outward or toward a side of the main body portion 530 opposite the right side frame 12 in the left-right direction, and has a hook 511, which is deformable in a direction perpendicular to the left-right direction. When each first support portion 510 is fitted into a corresponding hole 721 in the high voltage supply board 720, the hook 511 is caught in the hole 721 of the high voltage supply board 720. Thus, the high voltage supply board 720 is supported by the first support portions 510 such that the high voltage supply board 720 does not come off outward from each first support portion 510.

Specifically, two of the first support portions 510 are spaced apart from each other in the front-rear direction in an upper portion of the duct 600, and the remaining two of the first support portions 510 are spaced apart from each other in the front-rear direction in a lower portion of the main body portion 530. The lower two first support portions 510 are disposed to the front side relative to the upper two first support portions 510. With this positional relationship, an area AC enclosed by supporting points of the first support portions 510 is shaped like a parallelogram.

The first support portions 510 supporting the high voltage supply board 720 are disposed at positions apart from the edges of the high voltage supply board 720 toward a center thereof (FIG. 3).

The second support portions 520 are supported by the cylindrical bosses 12E (upper two only shown) of the right side frame 12. The upper two second support portions 520 are end portions of two arm portions 540 extending upward from the upper end of the main body portion 530 and the lower second support portion 520 is an end portion of an arm portion 540 extending downward from the lower end of the main body portion 530. Each of the second support portions 520 has a hole 520A into which a corresponding screw S2 for securing the second support portion 520 to the boss 12E is to be inserted.

Figure 6:
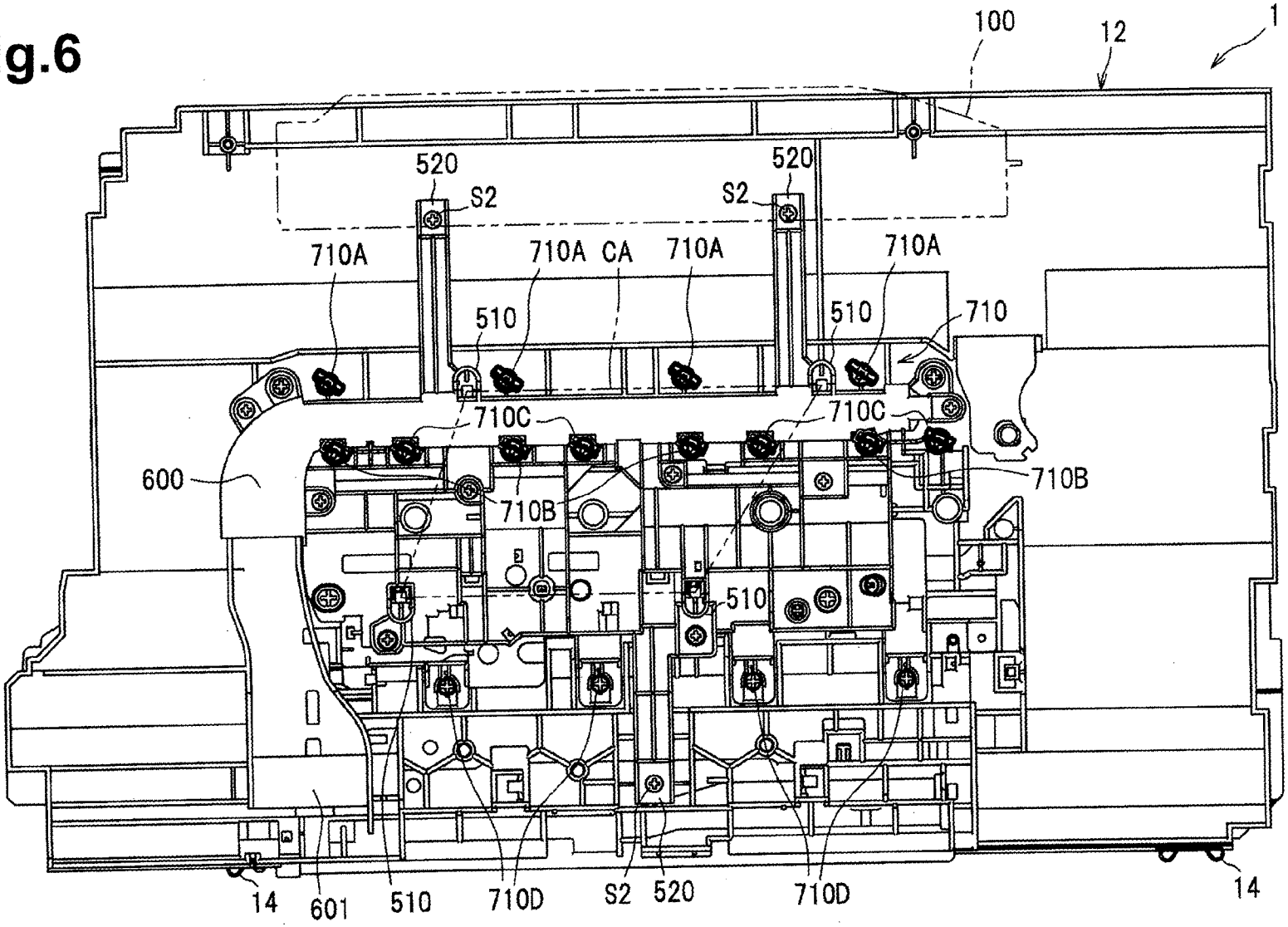
FIG. 6 is a side view of the right side frame assembled with the sub frame.

As shown in FIG. 6, the second support portions 520 are disposed outside the area CA enclosed by the supporting points of the first support portions 510. Specifically, the second support portions 520 are disposed such that the second support portions 520, when projected in the left-right direction, do not overlap the developing cartridges 53. As schematically shown in FIG. 7, the second support portions 520 are configured to transmit forces F from the coil spring electrode 710 (for example, the developing-use electrode 710B) via the high voltage supply board 720 and the sub frame 500 toward the edges of the right side frame 12. Thus, this structure can reduce the deformation of the right side frame 12 made of resin.

As shown in FIG. 6, the upper two second support portions 520 are disposed such that the second support portions 520, when projected in the left-right direction, overlap the first connecting frame 100. As shown in FIG. 7, the upper second support portion 520 can transmit the force F transmitted from the coil spring electrode 710 via the high voltage supply board 720 and the sub frame 500 toward a portion of the right side frame 12 connecting the first connecting frame 100 in which the right side frame 12 is resistant to deformation in the left-right direction. Thus, this structure can reduce the deformation of the right side frame 12 more reliably.

The second support portions 520 are disposed at positions vertically apart from the drawer 60. To allow the drawer 60 to move, connecting parts for connecting the right side frame 12 and the left side frame 13, for example, the first and second connecting frames 100 and 200, and the lower beams 14, are not disposed in a moving range of the drawer 60. The connecting parts are disposed at positions vertically apart from the drawer 60. Thus, as shown in FIGS. 6 and 7, the second support portions 520 disposed at the positions vertically apart from the drawer 60, e.g., the lower second support portion 520, can be disposed near the connecting parts, e.g., the lower beams 14, and this structure can reduce the deformation of the right side frame 12 more reliably.

Two central developing-use electrodes 710B of the four developing-use electrodes 710B and two central grid-use electrodes 710C of the four grid-use electrodes 710C are disposed within the area CA. In other words, the electrodes 710B and 710C disposed within the area CA correspond to an example of a springy electrode.

As the electrodes 710B and 710C are disposed within the area CA, a portion of the high voltage supply board 720 which receives urging forces from the electrodes 710B and 710C can be enclosed by the first support portions 510. This structure can reduce the deformation of the high voltage supply board 720.

The coil spring electrodes 710 except for the electrodes 710B and 710C disposed within the area CA are an example of a further springy electrode, and disposed outside the area CA. As the coil spring electrodes 710 are dispersedly disposed inside and outside the area CA, the deformation of the high voltage supply board 720 can be reduced more reliably.

According to the embodiment, the following effects can be obtained in addition to the above described effect.

The sub frame 500 is made of a material with a higher Young's modulus than that of the right side frame 12, and thus the sub frame 500 is more resistant to deformation than the right side frame 12 is. This reduces the deformation of the high voltage supply board 720 and the right side frame 12 more reliably.

The high voltage supply board 720 is disposed outside the right side frame 12 in the left-right direction. Thus, when the drawer 60 is attached to or removed from the main body 10, the drawer 60 does not collide with the high voltage supply board 720.

The four wire-use electrodes 710A are arranged in the front-rear direction, and the upper two first support portions 510 and the lower two first support portions 510 are arranged in the front-rear direction. Even when the high voltage supply board 720 receives urging forces from the four wire-use electrodes 710A arranged in the front-rear direction, the first support portions 510 arranged in the front-rear direction support the high voltage supply board 720 to reduce deformation of the high voltage supply board 720.

The coil spring electrodes 710 have compressed coil springs. The coil spring electrodes 710 can generate stable pressing force to reduce the movement of the process units 50 in the left-right direction relative to the right side frame 12.

In the above embodiment, the right side frame 12 is insufficient in strength as it is provided with the through holes 12D through which the coil spring electrodes 710 pass. However, the right side frame 12 is reinforced with the sub frame 500 attached thereto, and the deformation of the right side frame 12 is reduced.

The above embodiment shows, but is not limited to, the coil spring electrodes 710 having compressed coil springs as an example of a springy electrode. The springy electrode may have a spring plate or a torsion spring.

The above embodiment shows, but is not limited to, the developing cartridges 53 as an example of a developing device. The developing cartridge may be a developing apparatus if the developing cartridge is comprised of a toner cartridge storing toner and a developing device storing a developing roller.

The above embodiment shows, but is not limited to, that the drawer 60 supports the process units 50. The process units 50 may be detachably attachable relative to the drawer 60. Alternatively, a part of a process unit 50, e.g., a developing cartridge 53, may be detachably attachable relative to the drawer 60. Alternatively, the drawer 60 may integrally include the photosensitive drums 51.

The above embodiment shows, but is not limited to, that the disclosure is applied to the color printer 1 as an example of the image forming apparatus. The disclosure may be applied to other image forming apparatus, e.g., a monochrome printer, a copier, and a multifunction machine.

The above embodiment shows, but is not limited to, the number of the first support portions and the second support portions. The number of the first support portions and the second support portions may be any if the first support portions can support the high voltage supply board and the second support portions can be supported by the right side frame, both at more than three points which are not on a straight line. The first support portions may be each comprised of a long plate-like rib and a cylindrical boss such that both end portions of the rib and the boss support the high voltage supply board at three points.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus comprising:

an image forming unit including a photosensitive drum configured to rotate about a rotation axis of the photosensitive drum and a developing device configured to supply developer to the photosensitive drum;

a resin frame configured to support a first end of the image forming unit in an axial direction of the photosensitive drum;

a sub frame supported by the resin frame;

a board supported by the sub frame, the board configured to supply power to the image forming unit; and a springy electrode configured to electrically connect the image forming unit and the board, the springy electrode being disposed on the board and apart from edges of the board such that the springy electrode is compressed between the image forming unit and the board, wherein the sub frame includes a plurality of first support portions disposed to support the board at at least three support points and a plurality of second support portions disposed to be supported by the resin frame at at least three support points, wherein the first support portions of the sub frame supporting the board are located apart from edges of the board, wherein the second support portions of the sub frame are disposed outside an area, viewed in the axial direction, enclosed by the at least three support points of the first support portions, a first one of the second support portions is disposed on a first side of the area in a direction perpendicular to the axial direction and a second one of the second support portions is disposed on a second side of the area opposite to the first side of the area, and wherein the sub frame is sandwiched by the resin frame and the board.

2. The image forming apparatus according to claim 1, wherein the springy electrode is disposed within the area enclosed by the at least three support points of the first support portions.

3. The image forming apparatus according to claim 2, further comprising a further springy electrode disposed on the board such that the further springy electrode is compressed between the image forming unit and the board, wherein the further springy electrode is disposed outside the area enclosed by the at least three support points of the first support portions.

4. The image forming apparatus according to claim 1, further comprising:

a second frame spaced apart from the resin frame in the axial direction of the photosensitive drum such that the image forming unit is between the second frame and the resin frame; and a connecting frame connecting the resin frame and the second frame, wherein the second support portions of the sub frame, when projected in the axial direction of the photosensitive drum, overlap the connecting frame.

5. The image forming apparatus according to claim 1, wherein the sub frame has a higher Young's modulus than the resin frame.

6. The image forming apparatus according to claim 1, wherein the sub frame and the board are disposed on a side of the resin frame opposite from the image forming unit, and wherein the resin frame and the sub frame have through holes to allow the springy electrode to pass through.

7. The image forming apparatus according to claim 1, further comprising:

a further image forming unit including a further photosensitive drum configured to rotate about a rotation axis of the further photosensitive drum and a further developer container configured to supply developer to the further photosensitive drum, the image forming unit and the further image forming unit being arranged in an arrangement direction perpendicular to the axial direction; and a further springy electrode disposed on the board such that the further springy electrode is compressed between the image forming unit and the board, the further springy electrode and the springy electrode being arranged in the arrangement direction, wherein at least two of the at least three support points of the first support portions are arranged in the arrangement direction.

8. The image forming apparatus according to claim 7, further comprising a drawer configured to support the image forming unit and the further image forming unit and move relative to the resin frame in the arrangement direction, wherein the second support portions of the sub frame are disposed apart from the drawer in a direction perpendicular to the axial direction and the arrangement direction, and wherein the first one of the second support portions is disposed on a top side of the drawer and the second one of the second support portions is disposed on a bottom side of the drawer opposite to the top side of the drawer.

9. The image forming apparatus according to claim 1, wherein the springy electrode includes a compressed coil spring.

10. The image forming apparatus according to claim 1, wherein the board is configured to supply a high voltage to the image forming unit.

11. An image forming apparatus comprising:

an image forming unit including a photosensitive drum configured to rotate about a rotation axis of the photosensitive drum and a developing device configured to supply developer to the photosensitive drum;

a resin frame configured to support a first end of the image forming unit in an axial direction of the photosensitive drum;

a sub frame supported by the resin frame;

a board supported by the sub frame, the board configured to supply power to the image forming unit; and a springy electrode configured to electrically connect the image forming unit and the board, the springy electrode being disposed on the board and apart from edges of the board such that the springy electrode is compressed between the image forming unit and the board, wherein the sub frame includes a plurality of first support portions disposed to support the board at at least three support points and a plurality of second support portions disposed to be supported by the resin frame at at least three support points, wherein the first support portions of the sub frame supporting the board are located apart from edges of the board, wherein the second support portions of the sub frame are disposed outside an area, viewed in the axial direction, enclosed by the at least three support points of the first support portions, a first one of the second support portions is disposed on a first side of the area in a direction perpendicular to the axial direction and a second one of the second support portions is disposed on a second side of the area opposite to the first side of the area, and wherein a central portion of the board is supported by the sub frame and upper and lower end portions of the board are supported by the resin frame.

* * * * *